US010722030B2

(12) United States Patent
Kilburn

(10) Patent No.: US 10,722,030 B2
(45) **Date of Patent: *Jul. 28, 2020**

(54) BLADE BASED CABINET SYSTEM

(71) Applicant: Chris Kilburn, Buskirk, NY (US)

(72) Inventor: Chris Kilburn, Buskirk, NY (US)

(73) Assignee: Switch Blade Design LLC, Buskirk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/298,554

(22) Filed: Mar. 11, 2019

(65) Prior Publication Data

US 2019/0200761 A1 Jul. 4, 2019

Related U.S. Application Data

(63) Continuation of application No. 15/674,673, filed on Aug. 11, 2017, now Pat. No. 10,271,652.

(60) Provisional application No. 62/374,036, filed on Aug. 12, 2016.

(51) Int. Cl.

| | |
|---|---|
| ***A47B 96/06*** | (2006.01) |
| ***A47B 47/05*** | (2006.01) |
| ***A47B 95/00*** | (2006.01) |
| ***E05D 15/06*** | (2006.01) |
| ***E05D 15/58*** | (2006.01) |
| ***A47B 77/10*** | (2006.01) |
| ***A47B 77/16*** | (2006.01) |
| ***A47B 96/20*** | (2006.01) |
| ***E04B 2/74*** | (2006.01) |

(52) U.S. Cl.

CPC ..... *A47B 96/067* (2013.01); *A47B 47/05* (2013.01); *A47B 95/008* (2013.01); *E05D 15/0604* (2013.01); *E05D 15/58* (2013.01); *A47B 77/10* (2013.01); *A47B 77/16* (2013.01); *A47B 96/201* (2013.01); *A47B 2210/0054* (2013.01); *E04B 2002/7483* (2013.01); *E05Y 2900/20* (2013.01)

(58) Field of Classification Search

CPC ..... A47B 96/07; A47B 96/06; A47B 77/00; A47B 47/0025

See application file for complete search history.

(56) References Cited

U.S. PATENT DOCUMENTS

| | | | |
|---|---|---|---|
| 1,714,909 | A | 5/1929 | Illmer |
| 3,950,049 | A | 4/1976 | Drass |
| 4,329,003 | A | 5/1982 | Manchester |
| 4,457,436 | A | 7/1984 | Kelley |

(Continued)

FOREIGN PATENT DOCUMENTS

| | | |
|---|---|---|
| EP | 1570765 B1 | 5/2008 |

OTHER PUBLICATIONS

International Search Report and Written Opinion dated Nov. 2, 2017 for PCT/US17/46463 filed Aug. 11, 2017; pp. 12.

(Continued)

*Primary Examiner* — Daniel J Rohrhoff
(74) *Attorney, Agent, or Firm* — Hoffman Warnick LLC

(57) ABSTRACT

A blade based cabinet system and method. A disclosed cabinetry system includes cabinetry system, comprising: a pair of mounting rails that are horizontally mountable to a wall; a set of blade assemblies, each having a substantially planar profile; and a mounting interface adapted to connect the set of blade assemblies to the pair of mounting rails, orthogonal to the wall to form a cabinet chassis.

20 Claims, 13 Drawing Sheets

(56) References Cited

U.S. PATENT DOCUMENTS

| | | | | |
|---|---|---|---|---|
| 5,050,832 | A | 9/1991 | Lee et al. | |
| 5,152,593 | A | 10/1992 | Domenig | |
| 5,222,611 | A * | 6/1993 | Wood | A47B 95/008 211/94.01 |
| 5,718,493 | A | 2/1998 | Nikolai | |
| 5,964,438 | A * | 10/1999 | Camilleri | A47B 95/008 248/225.21 |
| 7,228,977 | B2 | 6/2007 | Perkins et al. | |
| 8,684,195 | B1 | 4/2014 | Caruso | |
| 10,271,652 | B2 * | 4/2019 | Kilburn | E05D 15/58 |
| 2008/0224579 | A1 * | 9/2008 | Juten | A47B 96/067 312/111 |
| 2009/0152217 | A1 | 6/2009 | Gmerek et al. | |
| 2011/0147551 | A1 * | 6/2011 | Richard | A47B 96/067 248/222.14 |
| 2011/0169386 | A1 | 12/2011 | Lindvall | |
| 2011/0309731 | A1 * | 12/2011 | Lindvall | A47B 95/008 312/352 |
| 2012/0018602 | A1 * | 1/2012 | Cattaneo | A47B 95/008 248/222.11 |
| 2013/0180202 | A1 * | 7/2013 | Woods | A47B 5/00 52/710 |
| 2015/0351538 | A1 | 12/2015 | Wells et al. | |
| 2017/0227161 | A1 * | 8/2017 | Winikoff | A47B 95/008 |
| 2017/0340142 | A1 * | 11/2017 | Gonzalez | A47B 57/565 |

OTHER PUBLICATIONS

Non Final Office Action dated Apr. 11, 2018 for U.S. Appl. No. 15/674,673, filed Aug. 11, 2017; CTF-0001-US; pp. 15.

Final Office Action dated Oct. 10, 2018 for U.S. Appl. No. 15/674,673, filed Aug. 11, 2017; CTF-0001-US; pp. 11.

Notice of Allowance dated Jan. 8, 2019 for U.S. Appl. No. 15/674,673, filed Aug. 11, 2017; CTF-0001-US: pp. 6.

* cited by examiner

BLADE BASED CABINET SYSTEM

PRIORITY CLAIM

This application claims priority to co-pending application Ser. No. 15/674,673, filed on Aug. 11, 2017 entitled BLADE BASED CABINET SYSTEM, the contents of which is hereby incorporated by reference.

FIELD OF THE INVENTION

This disclosure is related generally to cabinets, and more particularly to a modular cabinetry system and method that allows cabinet components to be customized, built and installed on site using blade based components.

BACKGROUND OF THE INVENTION

Kitchen cabinetry and the like are fundamental fixtures found in almost every home. Although the aesthetics and craftsmanship may vary from product line to product line, almost all kitchen cabinets are installed in the same manner. Namely, a designer (or installer) evaluates the available space and generates a design layout according to standard sizes available from a given manufacturer. Cabinets are then ordered (or are custom built) and delivered to the site. Alternatively, cabinets are custom manufactured at great expense and time. A contractor installs the cabinets by mounting each cabinet to the wall or floor, and then they are finished with a countertop and/or any necessary customization to provide a finished look.

While there may be some variation among products lines, cabinetry generally includes wall cabinets that are mounted to the wall or base cabinets that are mounted to the floor and/or adjacent wall. Larger kitchens may utilize dozens of individual cabinets, each of which must be manufactured off-site according to predetermined specifications, packaged and shipped in bulky containers. The contractor in turn is then tasked with moving, un-packaging and installing numerous bulky and heavy pieces of "furniture." Between planning, manufacturing, shipping and installation, cabinetry can represent significant cost when installing or remodeling a kitchen.

Moreover, while quality of materials and craftsmanship may vary, the end-user, i.e., the homeowner, primary only sees the front face (and inside) of the cabinets. A large portion of the material, weight, structure, and craftsmanship is hidden once a cabinet is installed. Furthermore, because of the inherent structure of box-framed cabinets, there is often a significant amount of unusable space, especially when a series of adjacent cabinets are installed. Accordingly, much of the cost associated with kitchen cabinetry does not benefit the homeowner.

SUMMARY OF THE INVENTION

The present invention relates to a blade-based cabinet system and methodology for implementing the same.

In one embodiment, there is a cabinetry system, comprising: a pair of mounting rails that are horizontally mountable to a wall; a set of blade assemblies, each having a substantially planar profile; and a mounting interface adapted to connect the set of blade assemblies to the pair of mounting rails, orthogonal to the wall to form a cabinet chassis.

In a second embodiment, there is method of constructing a cabinet unit, comprising: horizontally attaching a pair of mounting rails to a wall; providing a set of blade assemblies, each having a substantially planar profile; and connecting the set of blade assemblies to the pair of mounting rails using a mounting interface to form a cabinet chassis such that the blade assemblies are positioned orthogonal to the wall.

The illustrative aspects of the present invention are designed to solve the problems herein described and other problems not discussed.

BRIEF DESCRIPTION OF THE DRAWINGS

These and other features of this invention will be more readily understood from the following detailed description of the various aspects of the invention taken in conjunction with the accompanying drawings.

Figure 1:
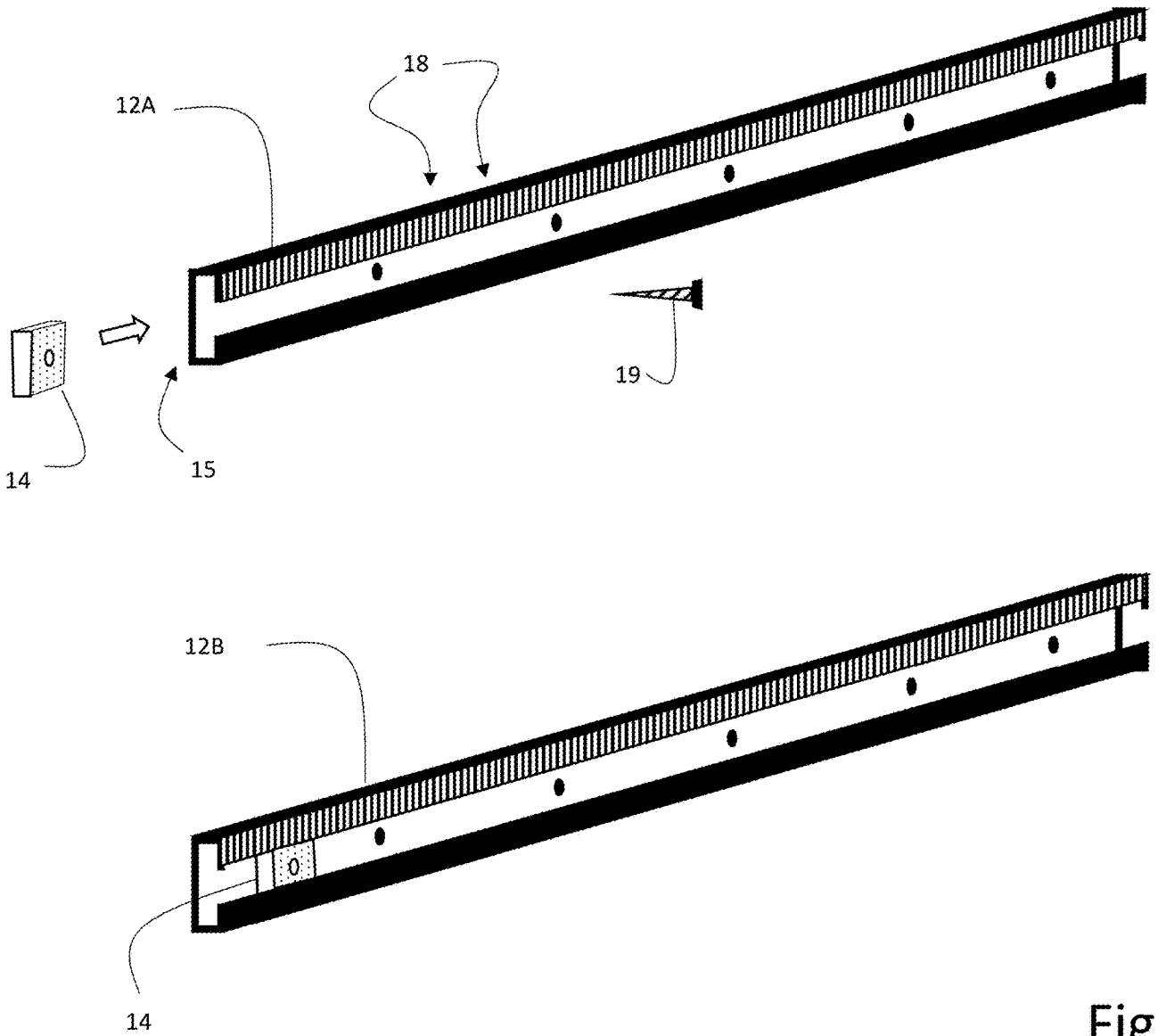
FIG. 1 depicts a pair of installed mounting rails in accordance with an embodiment of the present invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

Referring to figures, FIGS. 1-5 depict an illustrative method and associated components for building and installing a wall mounted blade based cabinet unit 10 (FIG. 5), in this case comprising two side-by-side cabinets. The blade based system provides numerous advantages, including: the fact that the same basic components can be utilized to create any number of different customizable cabinet configurations; the blade based system greatly reduces shipping costs because the cabinets can be shipped in flat container and be assembled and installed on site; the finished product creates more storage volume and flexibility; and the system allows the builder/owner greater flexibility in selecting and installing the finished panels.

FIG. 1 depicts a pair of mounting rails 12A and 12B that are horizontally mounting onto a wall or other surface. The length of mounting rails 12A, 12B may be precut or cut onsite to the width of the cabinet unit 10 being built (in this example, 72 inches for two 36 inch wall cabinets). Any number or type of cabinets may be incorporated into a single cabinet unit 10, so it is envisioned that the mounting rails 12A, 12B could run as long as the entire length of a wall (for a very large cabinet unit) or as short as the width of a single cabinet. Mounting rails 12A, 12B may be attached to a wall or other surface in any manner, e.g., with wood screws 19, bolts, nails or other known fasteners. In this illustrative embodiment, the mounting rails 12A, 12B comprise a C-channel profile 15, adapted to slidably receive a set of mounting inserts 14. However, it is understood that other mounting rail configurations/profiles could be utilized, e.g., I-beam, L-channel, etc.

Figure 2:
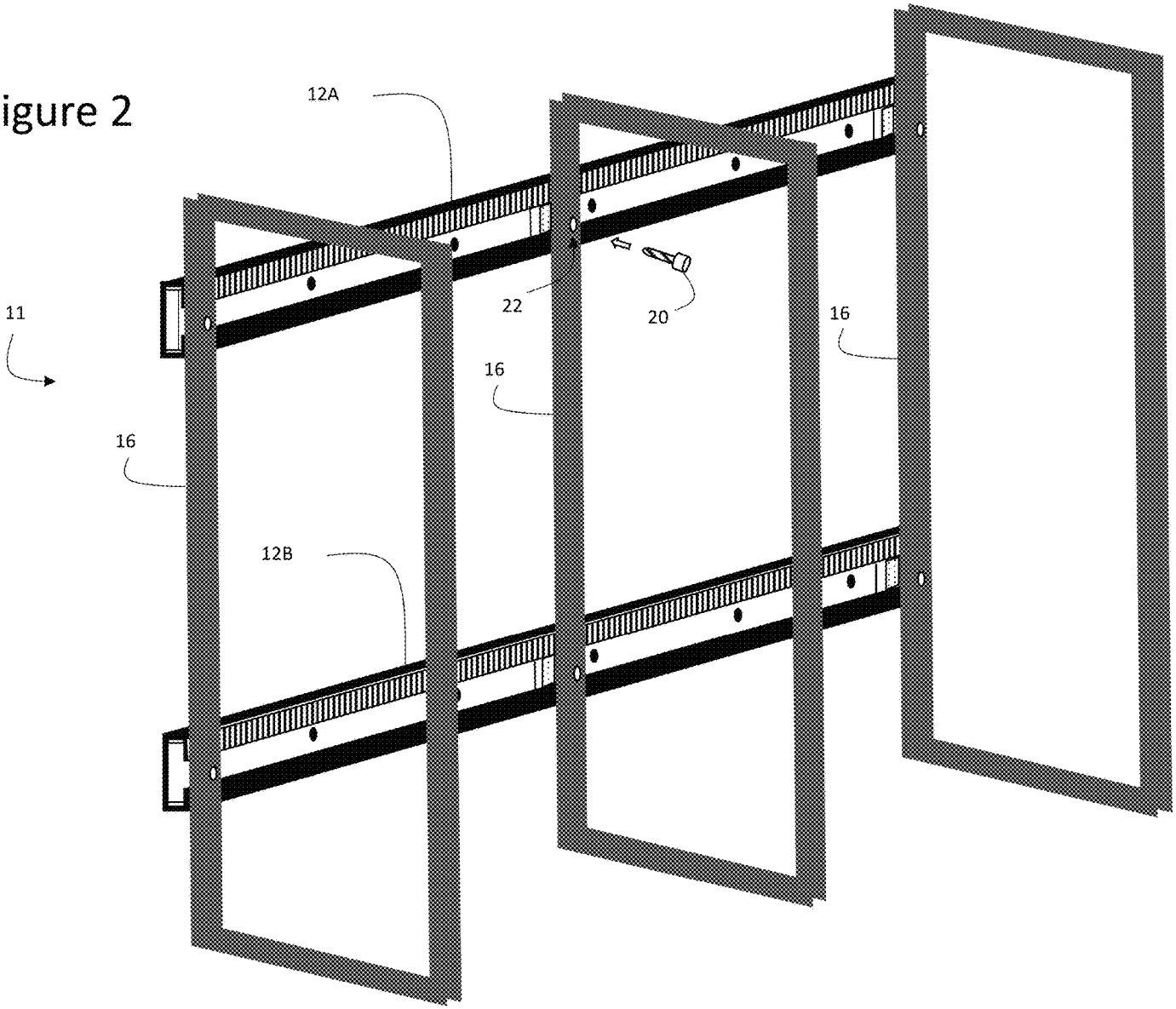
FIG. 2 depicts a set of blade assemblies attached to the mounting rails of FIG. 1 in accordance with an embodiment of the present invention.

The mounting inserts 14 are position in the mounting rails 12A, 12B to receive and attach a set of blade assemblies (or blades) 16, such as those shown in FIG. 2, to form a chassis 11. In this embodiment, the mounting inserts 14 form part of a mounting interface adapted to connect the set of blades 16 to the mounting rails 12A, 12B, orthogonal to the wall, thereby forming the cabinet chassis. Accordingly, the number of mounting inserts 14 used will depend on the number of blades 16 that are to be attached to the mounting rails 12A, 12B. Generally, the number of blades 16 used will be one more than the number (N) of cabinets in the unit 10, i.e., N+1. In this example, three blades 16 are used, including two outer blades that form the outer walls of the chassis and a central blade that divides two side-by-side cabinets. As shown in FIG. 2, an upper and a lower mounting insert 14 is used to secure each blade 16 to the mounting rails 12A, 12B.

As shown, each mounting rail 12A, 12B may include a series of markings that provide a measuring guide 18 (i.e., inches) to assist the installer in locating the blades 16. For example, if two 36 inch cabinets are planned, the installer can use the markings as a guide to properly locate adjacent blades 36 inches apart, etc. In another embodiment, the measuring guide 18 may simply indicate where the blades are to be located for a given unit 10.

Note that while each blade 16 has a generally rigid planar profile, the particular design and configuration of blades 16 may vary depending on the particular embodiment/system. For example, blades 16 may be fashioned out of sheet metal or other planar material, be implemented as open frames (as shown), comprise a continuous or partially continuous sheet of material, have various cutouts and features, comprise any material such as metal, composites, resins, wood, plastic, etc., be manufactured in different thicknesses, utilize tubular framing, comprise a mixture of materials, etc. It is however envisioned that for this illustrative embodiment/system, each of the blades 16 for a given cabinet size/type are substantially identical and interchangeable. However, in other embodiments/systems, different blades may be utilized (e.g., the outer blades may be different from the central blades, blades may differ by cabinet type, size, etc.). Furthermore, the height and depth of the blades 16 may be easily customizable.

Similarly, the particular mounting interface for attaching blades 16 to mounting rails 12A, 12B may vary, and a number of non-limiting illustrative embodiments are described herein. For example, in the depicted embodiment, mounting brackets 14 include threaded openings into which a bolt 20 or the like can be screwed, via an opening 22 in the associated blade 16. Other mounting interfaces may for example include the use of straps, U-bolts, clips, brackets, snap-in systems, hooks, etc. To accommodate different mounting interfaces, the configuration of mounting rails 12A, 12B may likewise vary. For example, rather than a C-channel profile fashioned from metal, mounting rails could utilize an H-shaped profile, an I-beam structure, an L-shaped profile, or any other shape or material. Further, mounting rails 12A, 12B could be adapted to mount directly to the underlying wall studs and have a depth equal to a later applied sheetrock (e.g., thickness of ⅜", ½", etc.), tile or other wall material. In this manner, the blades 16 can be mounted flush to the sheetrock to provide a clean look.

Figure 3:
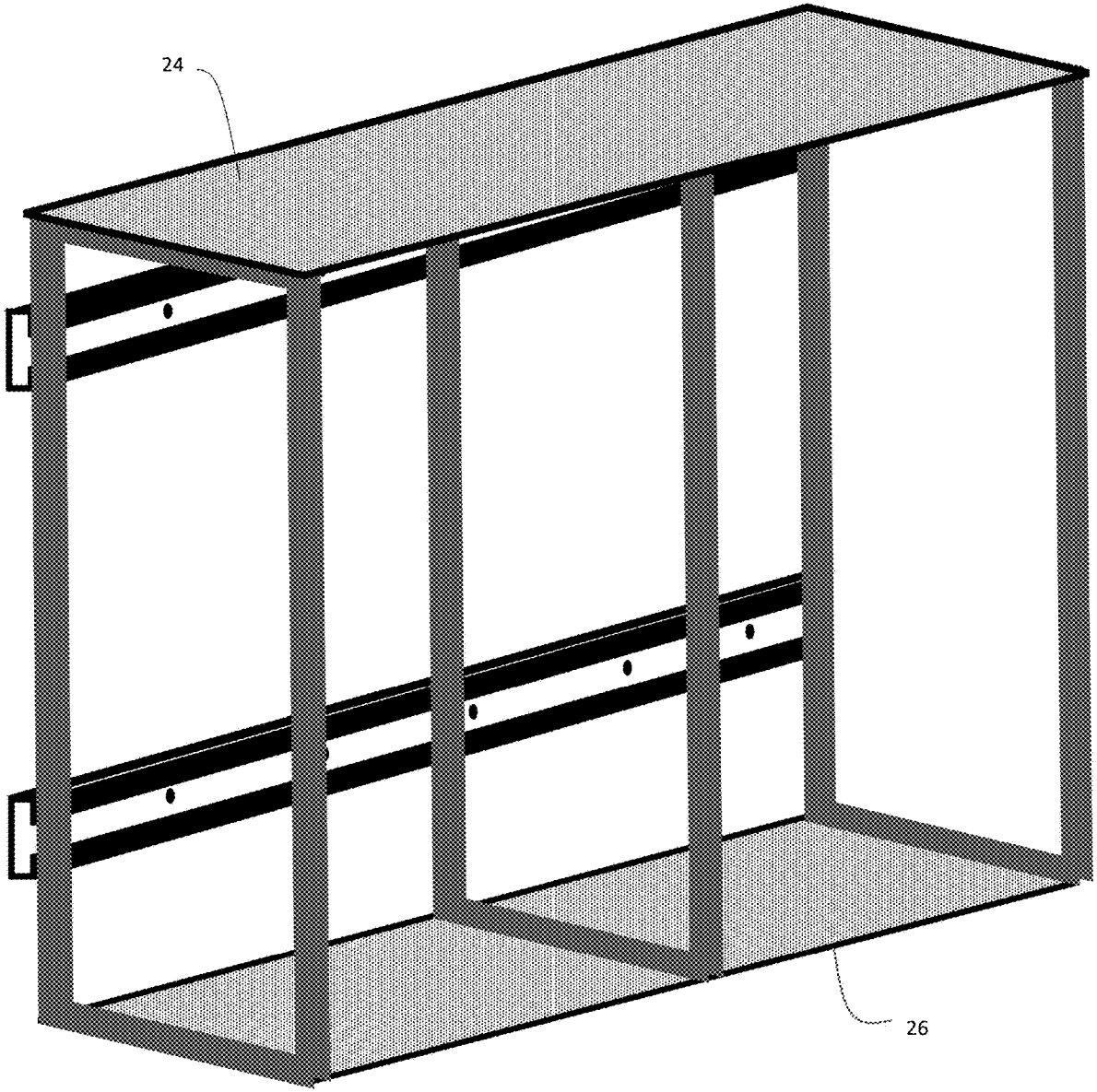
FIG. 3 depicts a partially formed cabinet having a top and bottom surface attached to the blade assemblies of FIG. 2 in accordance with an embodiment of the present invention.
Figure 4:
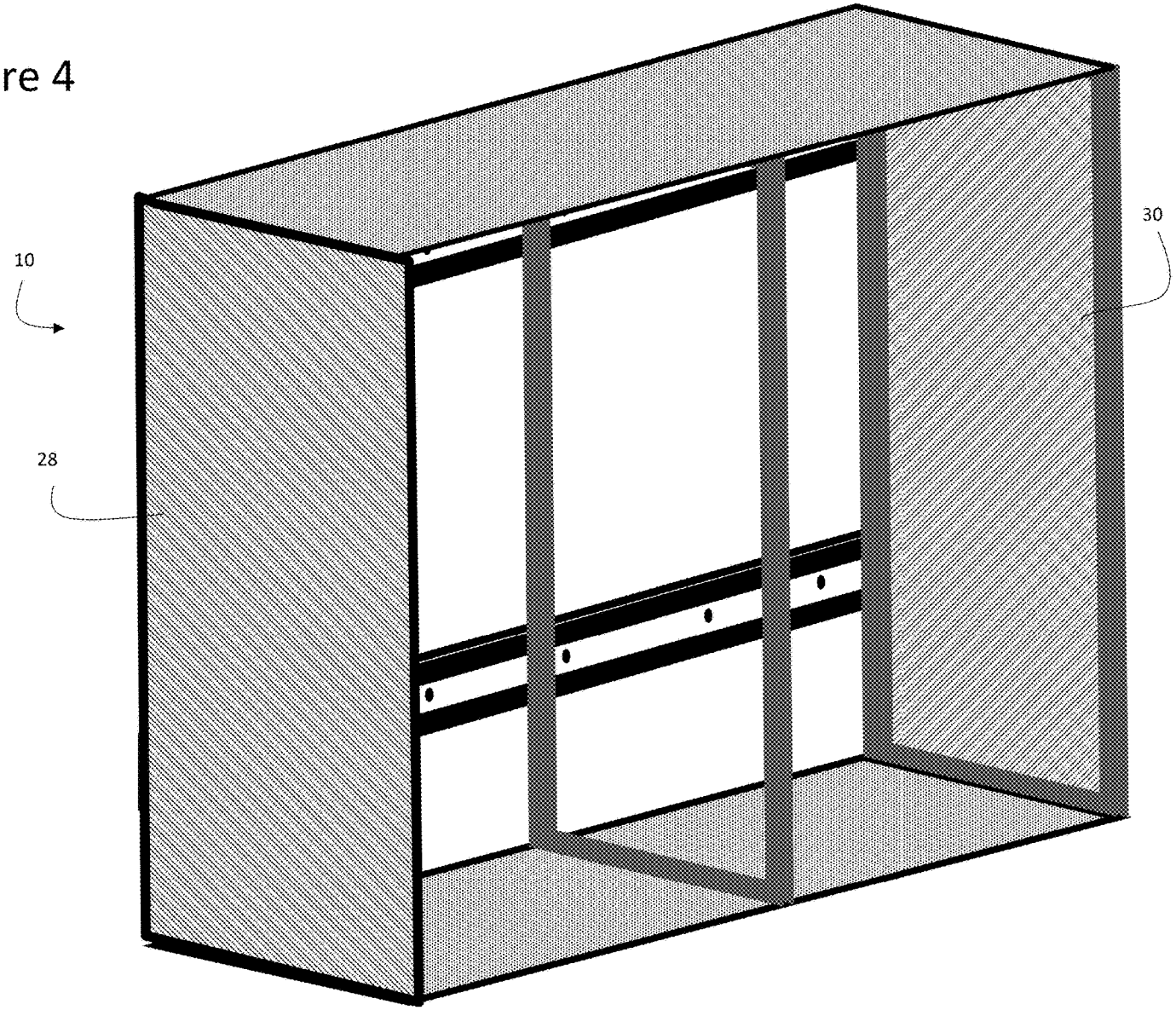
FIG. 4 depicts a further formed cabinet system having sidewalls attached to the blade assemblies in accordance with an embodiment of the present invention.
Figure 5:
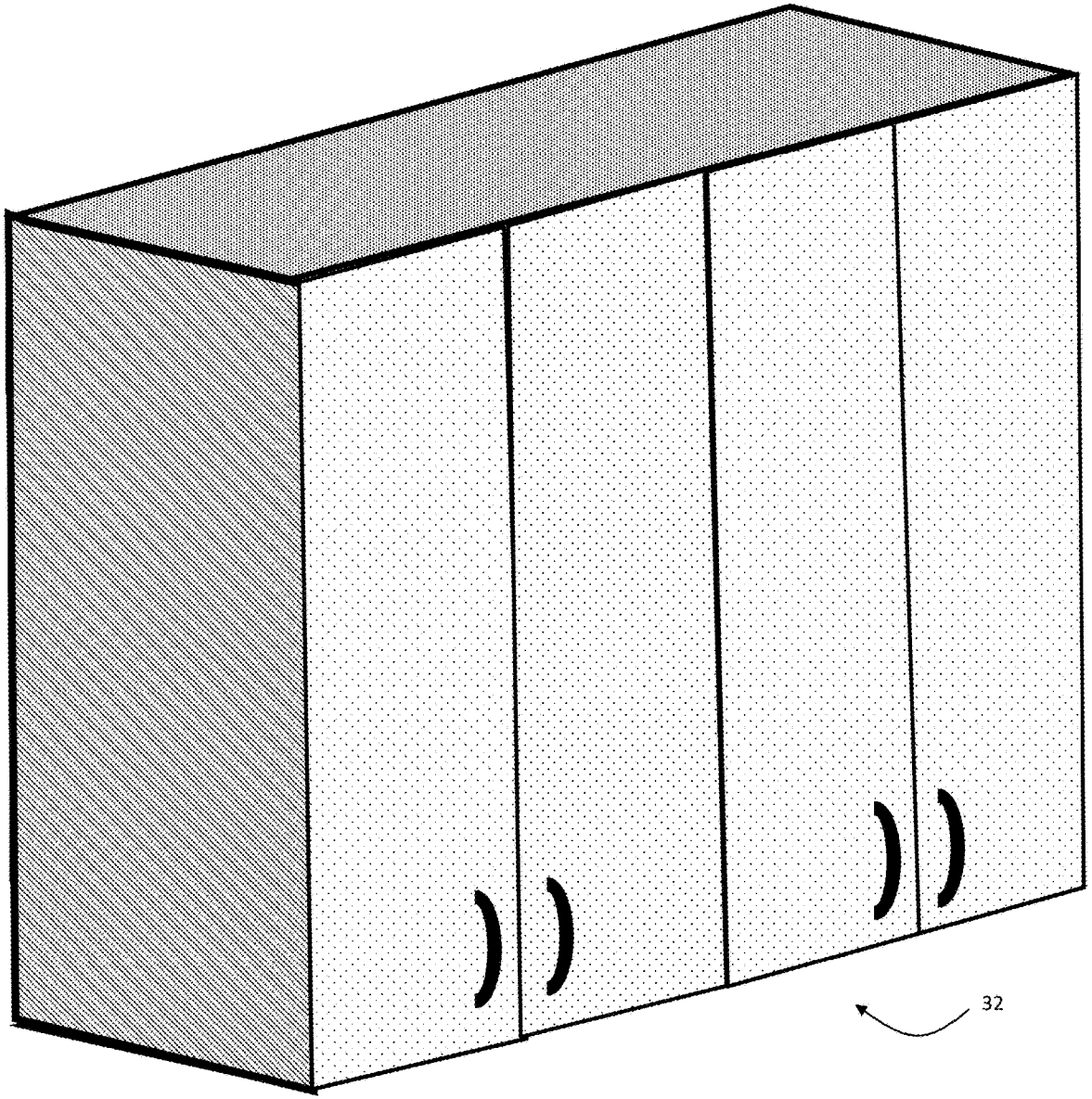
FIG. 5 depicts a finished cabinet having doors in accordance with an embodiment of the present invention.

Once the chassis 11 is assembled on a wall (i.e., mounting rails 12A, 12B and blades 16 are installed) finishing surfaces can be attached to complete the cabinet unit 10. As shown in FIG. 3, a top panel 24 and bottom panel 26 running the entire width of the unit 10 are attached to an upper section and a lower section of the blades 16, respectively. With the top surface 24 and bottom shelf 26 attached, the cabinet unit 10 becomes substantially rigid and stable. FIG. 4 depicts the cabinet unit 10 with side surfaces 28 and 30 attached. FIG. 5 shows a finished cabinet unit 10, with two sets of doors 32 attached. Any mechanism(s) may be utilized to connect finishing surfaces 24, 26, 28, 30, 32 to the blades 16 and each other, including bolts, screws, clips, hinges, glue, etc. Shelving, dividers, and other accoutrements may thereafter be added to finish the interior of the unit 10.

One of the features of this system is that the finishing surfaces 24, 26, 28, 30, 32 can be easily prefabricated for predefined sizes, styles and colors. As such, a builder/owner could try different samples in the actual space before committing to a final selection. This also gives the owner the ability to change the finishes if/when a new look is ever desired. Further, the use of this blade based system allows the builder to custom build finishing surfaces to accommodate unique styling or sizes, thus eliminating the need to special order entire cabinet systems. The builder can place adjacent blades 16 at any distance when assembling the chassis and custom build the necessary finishing surfaces to accommodate the size.

While the depicted embodiments in FIGS. 1-5 describe a system for fabricating and installing a wall cabinet unit, the same system may be utilized for base cabinet units. Note that in a base cabinet unit, a single mounting rail 12A may be utilized since the weight will largely be supported by the floor. For very large cabinets, three or more mounting rails could be used.

Figure 6:
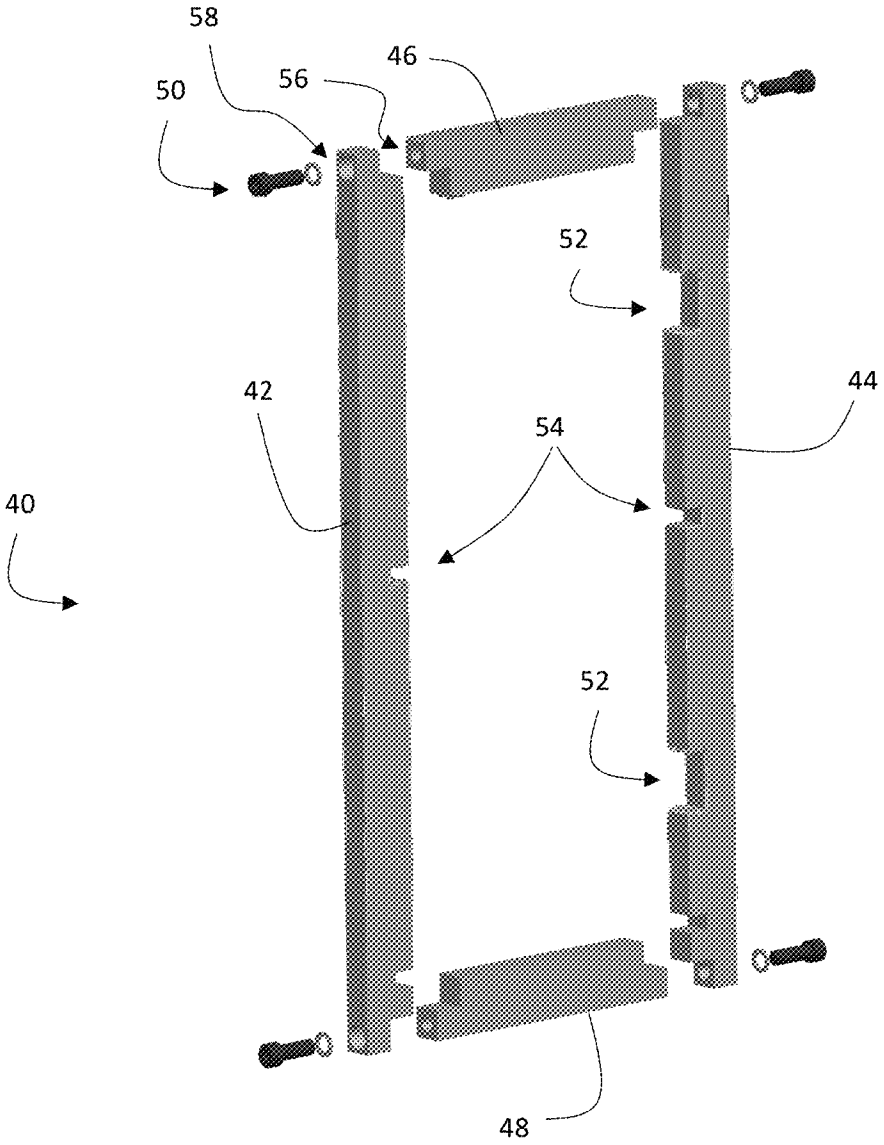
FIG. 6 an exploded view of an illustrative blade assembly in accordance with an embodiment of the present invention.
Figure 7:
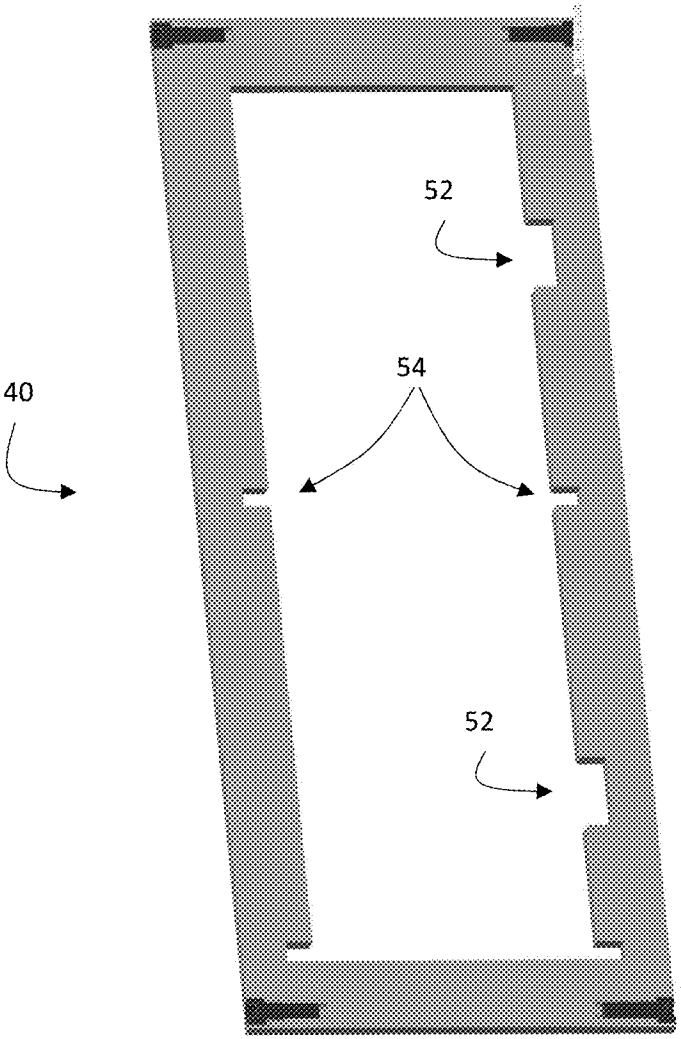
FIG. 7 depicts an assembled blade assembly in accordance with an embodiment of the invention.

FIG. 6 (exploded view) and FIG. 7 (assembled view) depict an illustrative blade assembly 40 that is assembled from several parts. In this embodiment, blade assembly 40 is assembled from a front section 42, a rear section 44, a top section 46 and a bottom section 28. The front and rear sections 42, 44 have transverse holes 58 bored there through for receiving a bolt 50, and the top and bottom section 46, 48 have threaded recesses 56 for receiving the bolt 50. Blade assembly 40 can either be assembled on site, or be pre-assembled, e.g., at a factory. Each of the sections 42, 44, 46, 48 may for example comprise precut aluminum or be fashioned from any other material. In this embodiment, rear section 44 includes mounting notches 52 that can be used with a clamp to connect the blade assembly 40 to a mounting rail (not shown). In this case, mounting notches 52 are cut as rectangles on the inside edge of the rear section 44. However, it is understood that mounting notches 52 could be cut on the outer edge of the rear section 44, and comprise a different shape (e.g., L-shaped, triangular, rounded, etc.). Furthermore, other features for forming a mounting interface to connect blade assembly 40 to a mounting rail could be used, e.g., a bored hole similar to transverse holes 58 for passing through a bolt, laterally drilled holes for receiving a U-bolt or clamp, snap-in features, hooks, etc. In addition, other features such as shelving notches 54 may be included for holding one or more shelves.

Figure 8:
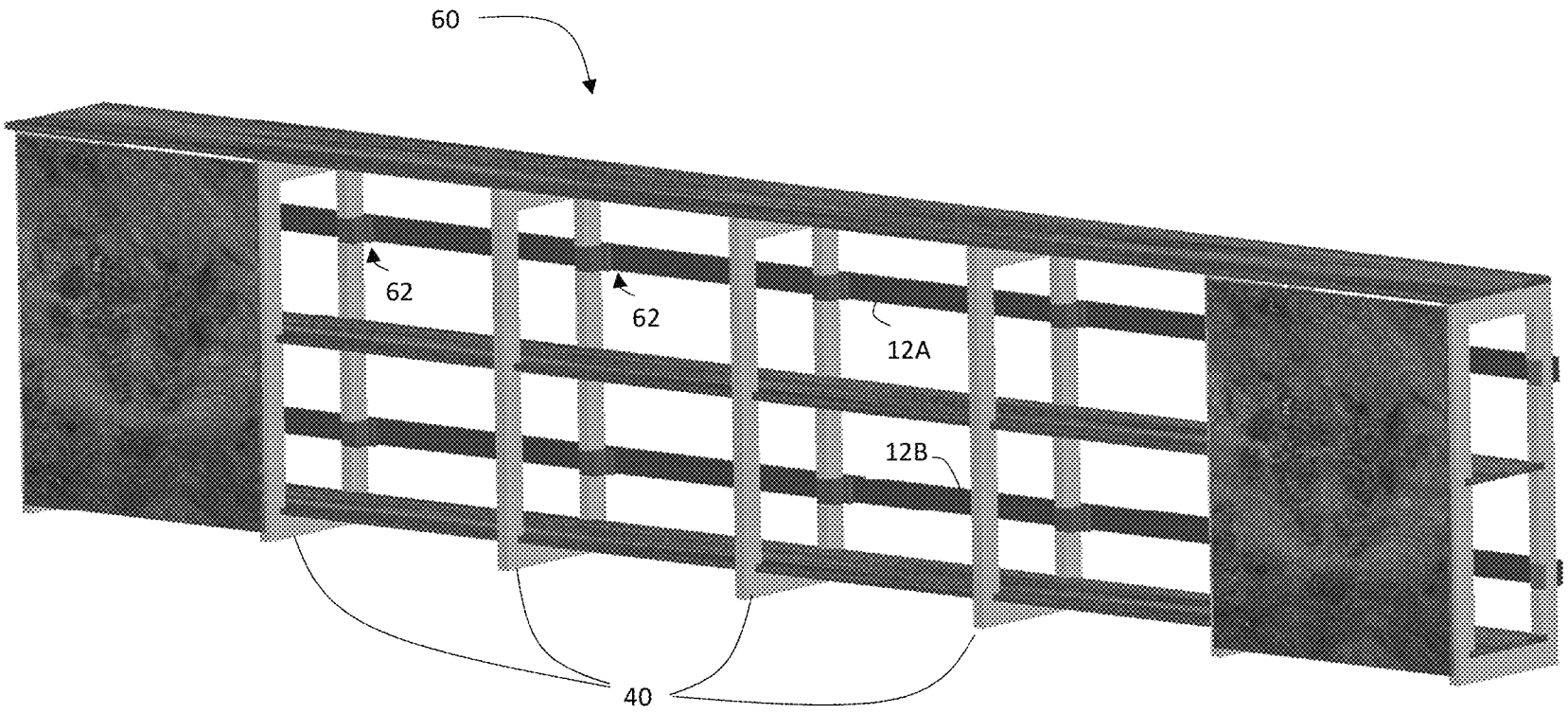
FIG. 8 depicts a partially assembled cabinet system in accordance with an embodiment of the present invention.

Referring now to FIG. 8, a partially assembled cabinet unit 60 is shown utilizing the blade assemblies 40 shown in FIGS. 6 and 7. In this embodiment, the mounting interface attaches blade assemblies 40 to mounting rails 12A, 12B with clamps 62 that mate with the mounting notches 52 (FIGS. 6, 7).

Figure 9:
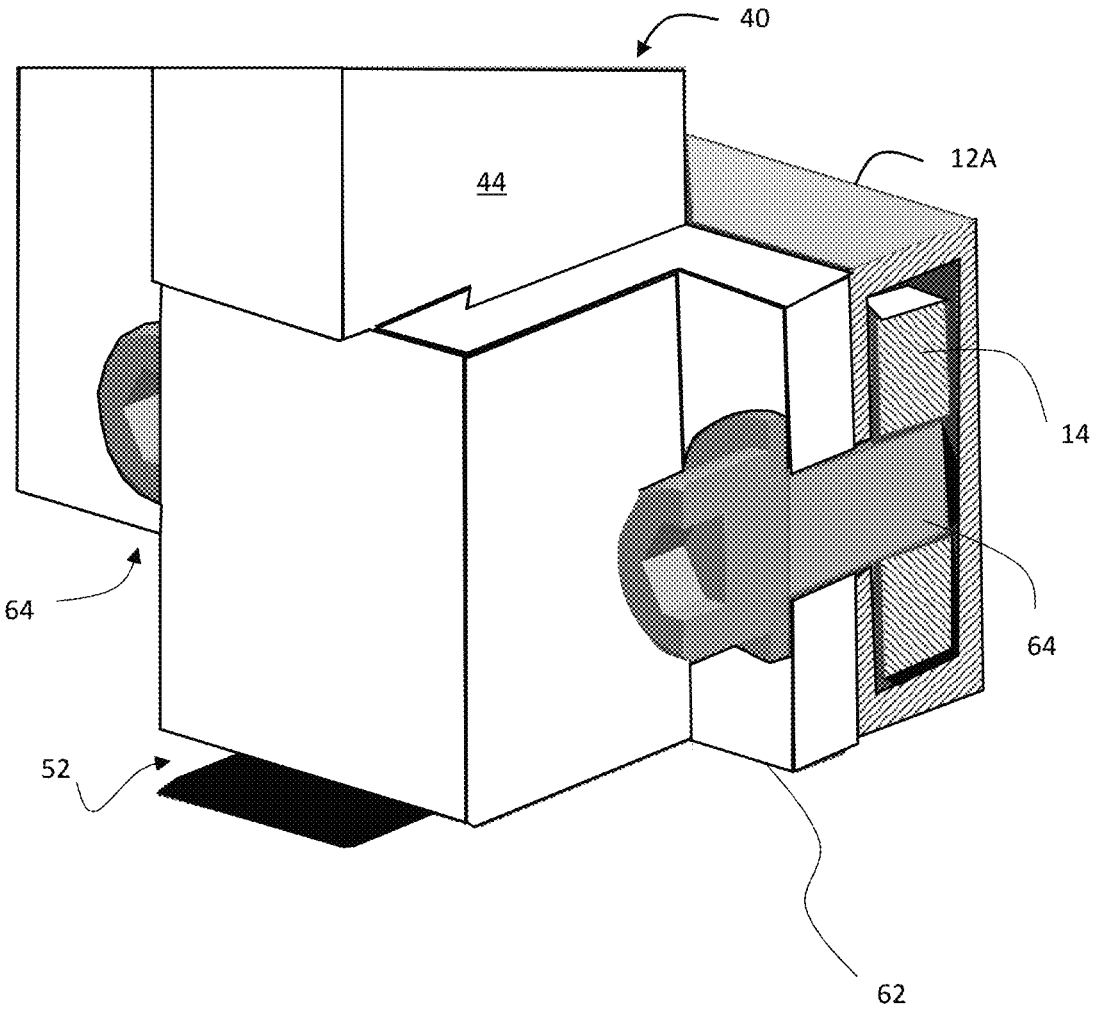
FIG. 9 depicts a mounting interface in accordance with an embodiment of the present invention.

FIG. 9 shown a partial cutaway view of a mounting interface in which clamp 62 attaches blade assembly 40 to mounting rail 12A. As shown, clamp 62 straddles (i.e., mates with) the mounting notch 52 of blade assembly 40 in the rear section 44 of blade assembly 40. Bolts 64 are passed through holes in the clamp 62, through the opening in the C-channel profile of mounting rail 12A, and into a threaded section in the mounting bracket 14 that is seated in the C-channel. When the bolts 64 are tightened, the blade assembly 40 is pulled toward and securely fasted to mounting rail 12A.

Figure 10:
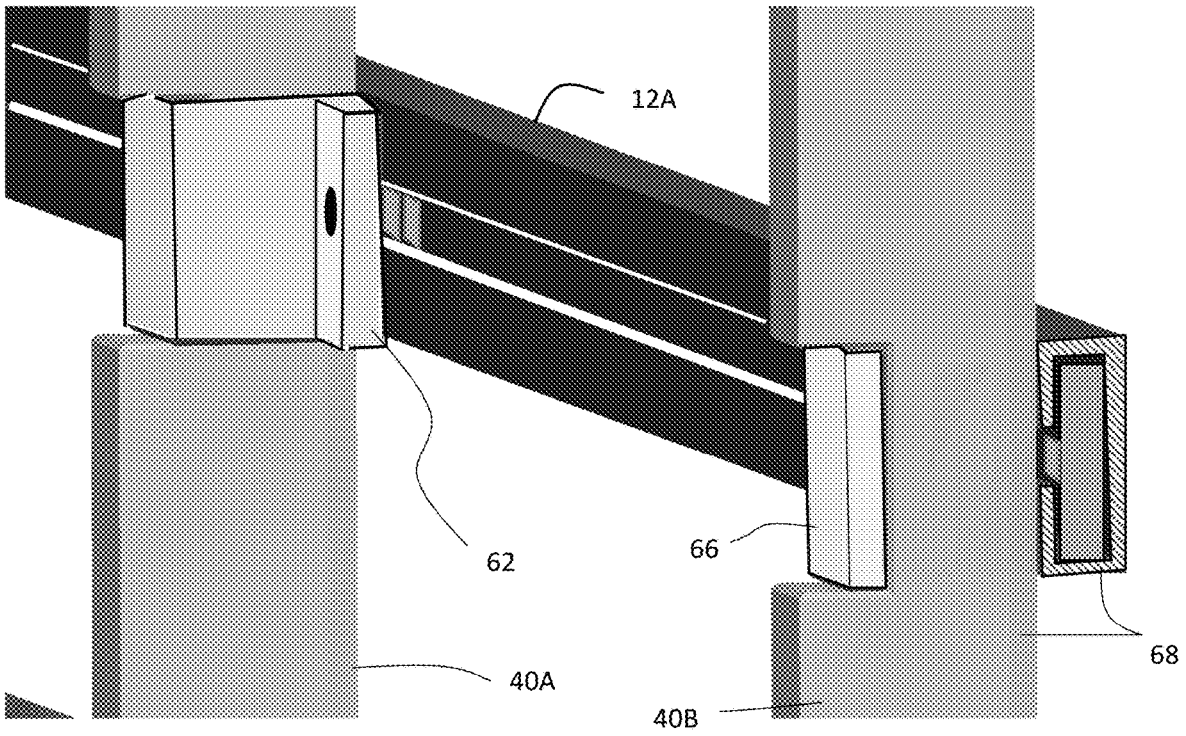
FIG. 10 depicts a further mounting interface in accordance with an embodiment of the present invention.

FIG. 10 shows two styles of clamps 62 and 66 for holding blade assemblies 40A, 40B to mounting rail 12A. Clamp 62 is essentially the same as described in FIG. 9, which is suitable for a blade assembly 40A positioned in a central portion of a cabinet chassis, whereas clamp 66 is designed for a blade assembly 40B at an end of the chassis. Clamp 66 only includes a single hole/bolt configuration (blocked from view) and is cut to mount flush with the outside edges 68 of blade assembly 40B and mounting rail 12A. This thus allows a finishing side panel to be flush mounted to the outside edge 68 of blade assembly 40B without interference from the clamp 66, thus completely covering the side of chassis from view. Clamp 66 includes a hole/bolt configuration (on the blocked side) similar to that found on both sides of clamp 62.

Figure 11:
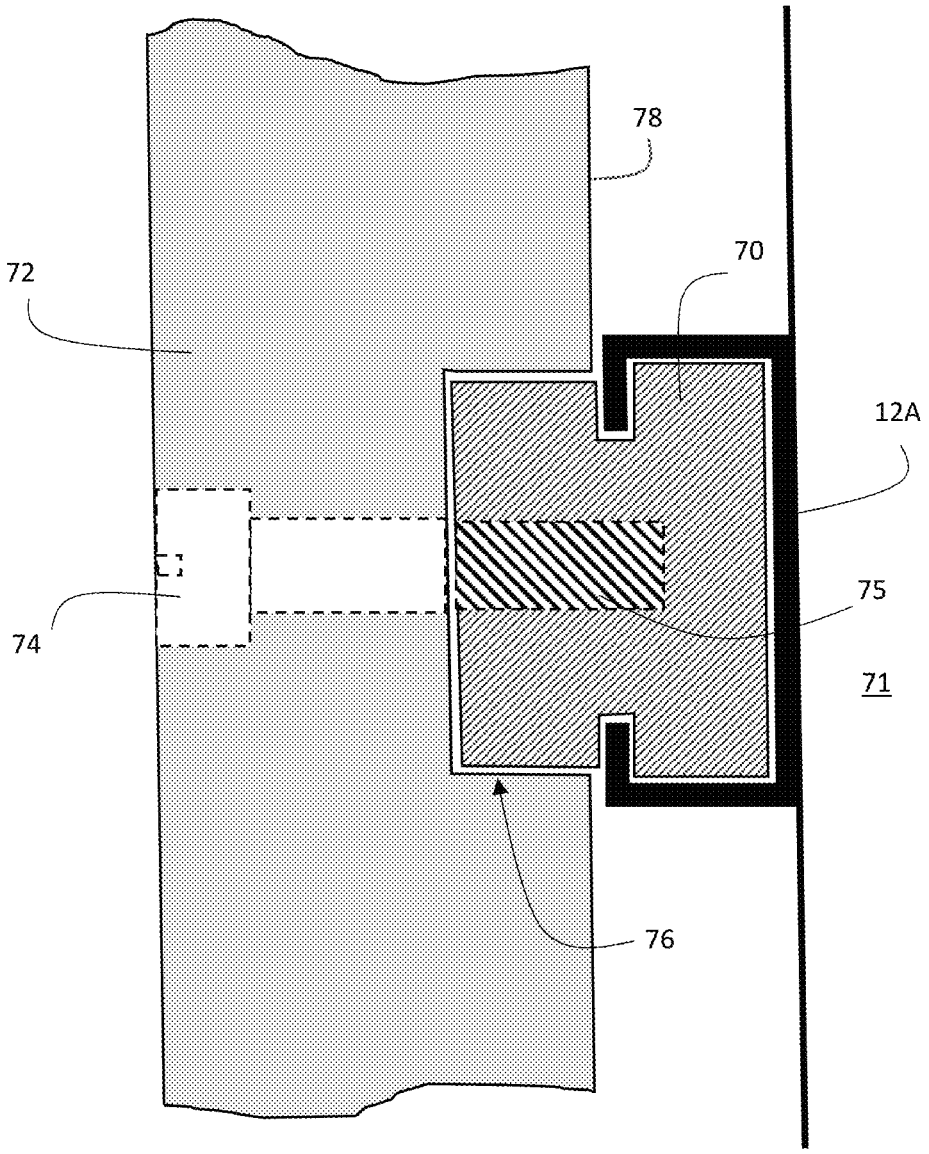
FIG. 11 depicts a further mounting interface in accordance with an embodiment of the present invention.

FIG. 11 depicts a partial side view of a blade assembly 72 connected to mounting rail 12A (shown in cross-section). Similar to other embodiments described herein, mounting rail 12A is C-shaped and is mounted to wall 71. However, in this embodiment, blade assembly 72 includes one or more notches 76 on an outer edge 78 of the rear section that faces the wall 71. An H-shaped mounting insert 70 is utilized that partially mates with the notch 76, and includes a threaded region 75 for receiving a bolt 74 that is slid and tightened through a bored passageway in the blade assembly 72. When the bolt 74 is tightened, the blade assembly 72, mounting insert 70, and mounting rail 12A are locked together. A feature of this design is that notch 76 allows the blade assembly 72 to rest on mounting insert 70, thus enhancing the ease of installation while providing additional support. In a further embodiment, blade assembly 76 may include a different and/or larger notch configuration that allows the blade assembly 76 to mate and rest on the mounting rail 12A itself, thus allowing blade assembly 76 to mount flush to the wall 71.

Figure 12:
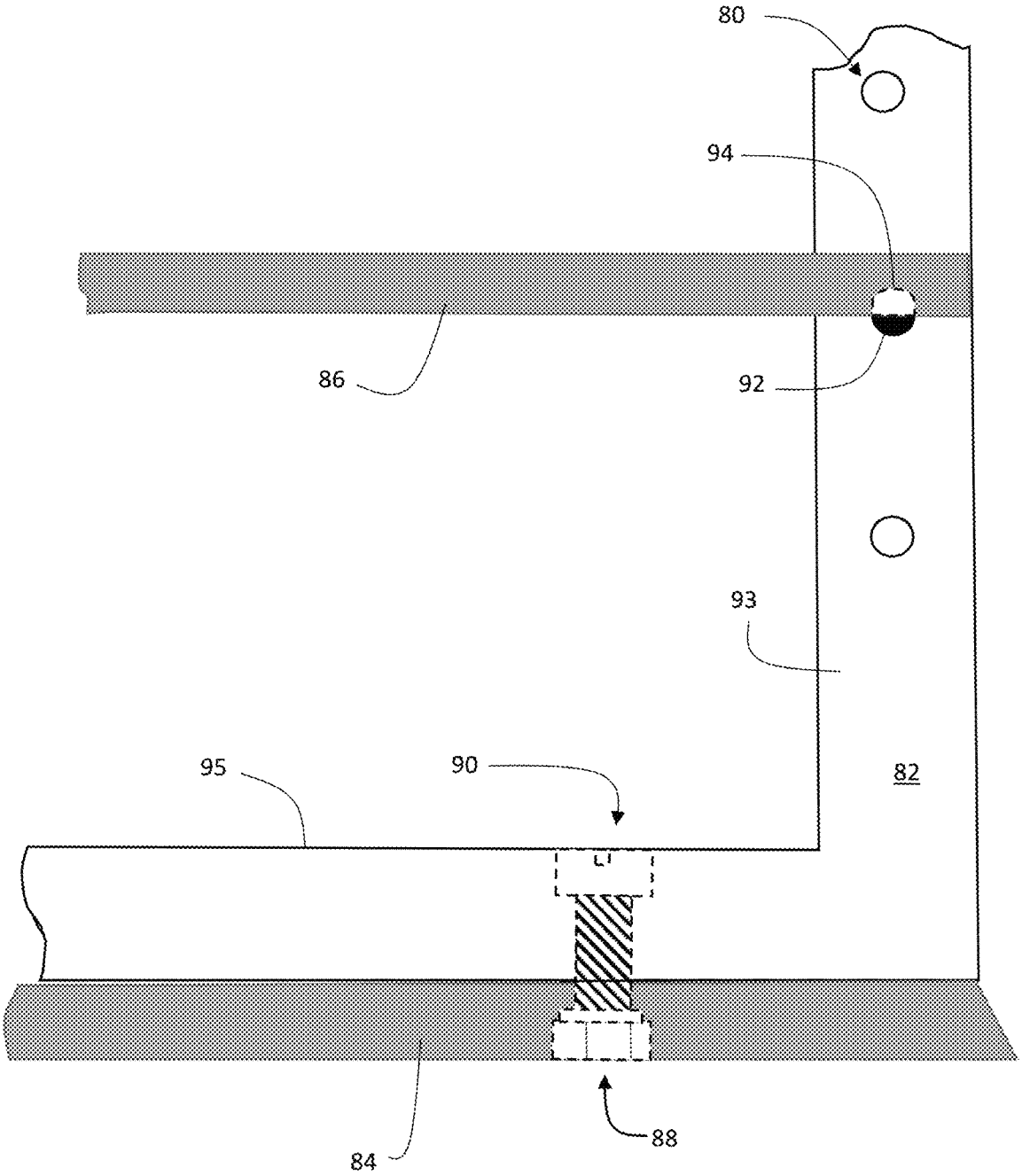
FIG. 12 depicts blade assembly with a shelving system in accordance with an embodiment of the present invention.

FIG. 12 depicts a partial side view (including a front 93 and bottom 95 section) of a blade assembly 82 that provides an illustrative embodiment for attaching panels or shelves 84, 86. In this example, a lower shelf (or finishing panel) 84 is attached to an underside of blade assembly 82 with a bolt 90 and nut 88. Both the blade assembly 82 and shelf 84 include pre-drilled holes for receiving the bolt 90 and nut 88 (as well as a washer). Pre-drilled holes may include recessed or shaped regions to simplify attachment and reduce visual impact. Any number of predrilled holes may be utilized to secure shelf 84, and a similar arrangement would be utilized on adjacent blade assemblies (not shown). A similar system may be utilized to attach a top panel (not shown).

On the front section 93 of blade assembly 82 is a peg 92 that for example extends outwardly (i.e., in and out of the page) from both sides of the front section 93. Shelf 86 may include a notch 94 to mate with the peg 92 to hold the shelf 86 in place. Any number of holes 80 may be bored through the front section 93 and rear section (not shown) to receive pegs 92, and allow for installation/placement of a shelf 86. A similar arrangement would be utilized on adjacent blade assemblies (not shown). It is understood that the embodiments shown in FIG. 12 for connecting shelves to a set of blade assemblies is but one of many possible attachment systems that may be employed, and should not be considered limiting. Such finishings may for example be attached with screws, bolts, hooks, adhesives, etc.

Figure 13:
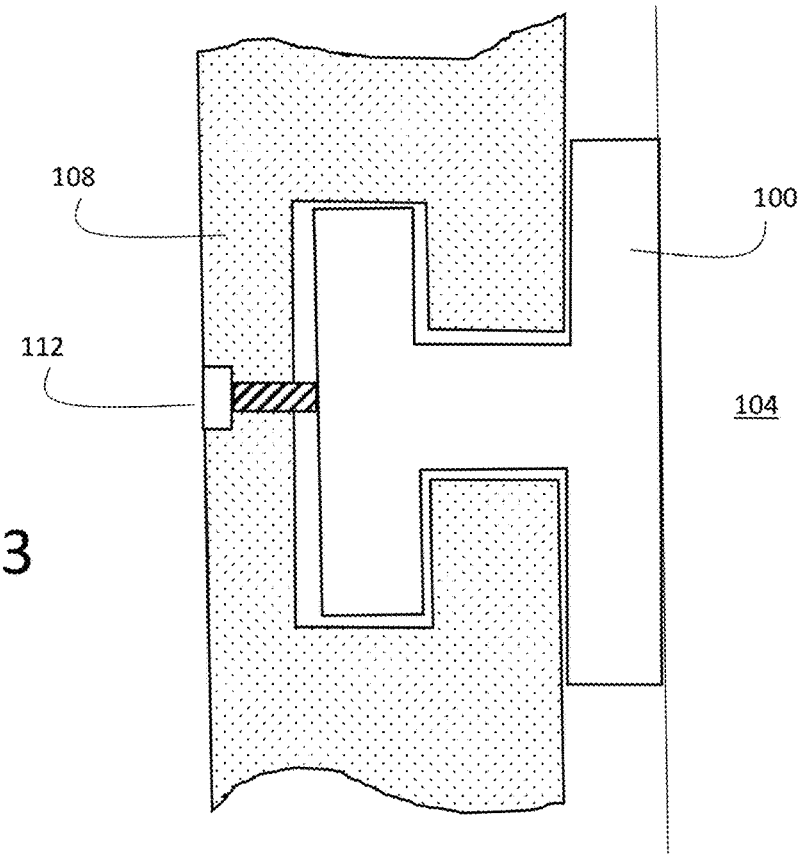
FIG. 13 depicts an alternative mounting interface in accordance with an embodiment of the present invention.
Figure 14:
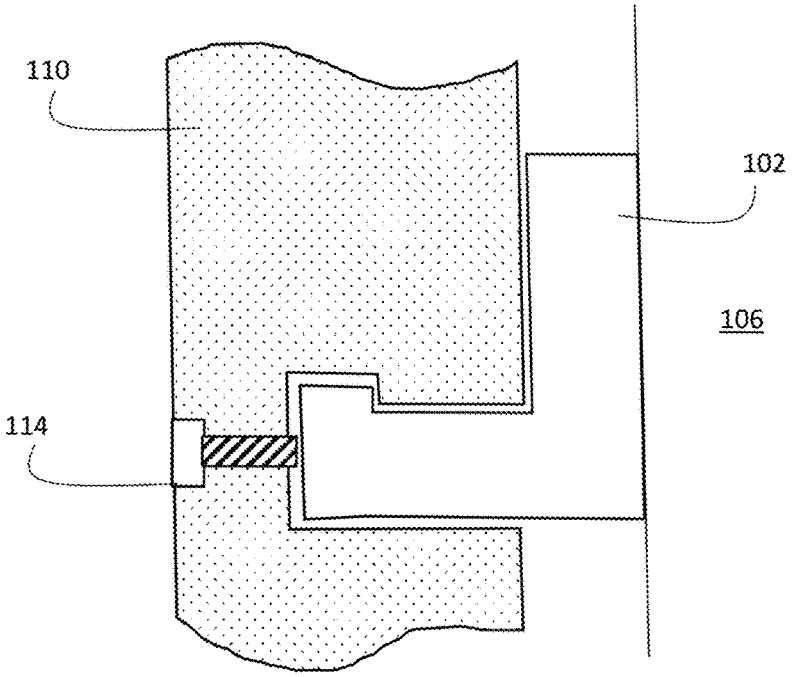
FIG. 14 depicts a further alternative mounting interface in accordance with an embodiment of the present invention.

FIGS. 13 and 14 depict alternative mounting interfaces. FIG. 13 provides a mounting rail 100 with an I-beam profile, in which the blade 108 is notched with a T-shaped cutout along the outer edge. The mounting rail 100 is mounted to the wall 104 using screws or like (not shown) as described herein. The blade itself 108 is slid onto the rail 100 from an end or entry point/break along the rail 100 and then fastened into position with a bolt 112 that is threaded through the blade 108. FIG. 14 depicts a mounting rail 102 with an L or J-shaped profile. The blade 110 is notched to either slide or snap onto mounting rail 102, and fasten into position with a bolt 114 that is threaded through the blade 110. The mounting rail 102 is mounted to the wall 106 using screws or like (not shown) as described herein. These interfaces allow the blade 108, 110 to be directly supported by the respective mounting rail 100, 102, thereby simplifying installation.

The described blade based design allows for easy packaging, shipping, installation and customization of a kitchen (or other similar type) cabinet. In particular, using the described system, the entire cabinet layout can be shipped using only flat components and be constructed on site. Once the chassis is installed, finishings, including doors, hardware, shelving, side panels, wine racks, etc., can be installed to create a finished cabinet look. Finishings can be selected from predefined configurations or be custom built to the owner's specification.

As noted, blade assemblies may be fabricated in any manner using any material that will provide suitable strength, e.g., aluminum, hardened steel, stainless steel, carbon fiber, wood, resin, plastics, anodized aluminum, laser etching, chrome and other metal treatments, etc. Blade assemblies may be fabricated from a generally planar material, use a framed cutout, a tubular structure, include a layered profile, have a U-shaped profile, an H-shaped profile, or any other arrangement. The assemblies may also be powder coated a predetermined color to protect and/or matches the finishings.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. An apparatus comprising:

a pair of mounting rails attachable to a wall;

a plurality of mounting inserts, each having a substantially H-shaped profile that is slideably engageable into a mounting rail; and a set of blade assemblies, each having a substantially planar profile, wherein each blade assembly is lockable to a pair of mounting inserts and the pair of mounting rails, such that each blade assembly is positioned orthogonal to the wall.

2. The apparatus of claim 1, wherein the plurality of mounting inserts includes a threaded region for receiving a fastener comprising a bolt.

3. The apparatus of claim 1, further comprising:

a top panel attachable to a top section of each of the blade assemblies; and a bottom panel attachable to a bottom section of each of the blade assemblies.

4. The apparatus of claim 1, wherein at least one of the pair of mounting rails includes a measuring guide for locating blade assemblies.

5. The apparatus of claim 1, wherein each of the blade assemblies comprises a notch on an outer edge thereof, wherein the notch mates with an associated mounting insert or a corresponding mounting rail.

6. The apparatus of claim 1, wherein the mounting rails include at least one of a substantially C-shaped profile, I-beam profile or an L-shaped profile.

7. The apparatus of claim 1, wherein each blade assembly includes a top section and a bottom section bolted to a front section and a rear section.

8. The apparatus of claim 1, wherein the mounting insert includes a mounting clamp on both sides of the blade assembly.

9. The apparatus of claim 1, wherein each mounting insert further includes a threaded area aligned with a bored passageway in each blade assembly, wherein a bolt locks each blade assembly to the mounting rail.

10. The apparatus of claim 1, further comprising a cabinet chassis formed by the blade assemblies being attached to the plurality of mounting inserts.

11. An apparatus comprising:

a pair of mounting rails attachable to a wall;

a plurality of mounting inserts, each adapted to slide into a mounting rail; and a set of blade assemblies, each blade assembly having a substantially planar profile, and including a notch on an inner edge thereof and a mounting clamp that mates with the notch and is connectable to an associated mounting insert, wherein each of the blade assemblies is lockable to a pair of mounting inserts and the mounting rails, such that each blade assembly is positioned orthogonal to the wall.

12. The apparatus of claim 11, wherein the plurality of mounting inserts includes a threaded region for receiving a fastener comprising a bolt.

13. The apparatus of claim 11, further comprising:

a top panel attachable to a top section of each of the blade assemblies; and a bottom panel attachable to a bottom section of each of the blade assemblies.

14. The apparatus of claim 11, wherein at least one of the pair of mounting rails includes a measuring guide for locating blade assemblies.

15. The apparatus of claim 11, wherein each of the blade assemblies comprises a notch on an outer edge thereof, wherein each notch mates with a corresponding mounting insert or a corresponding mounting rail.

16. The apparatus of claim 11, wherein the mounting rails include at least one of a substantially C-shaped profile, I-beam profile or an L-shaped profile.

17. The apparatus of claim 11, wherein the mounting insert includes a mounting clamp on both sides of the blade assembly.

18. The apparatus of claim 11, wherein each mounting insert further includes a threaded area aligned with a bored passageway in each blade assembly, wherein a bolt locks each blade assembly to the mounting rail.

19. The apparatus of claim 11, further comprising a cabinet chassis formed by the blade assemblies being attached to the plurality of mounting inserts.

20. An apparatus comprising:

at least one mounting rail attachable to a wall;

a plurality of mounting inserts, each having a substantially H-shaped profile that is slideably engageable into the at least one mounting rail; and a set of blade assemblies, each having a substantially planar profile, wherein each blade assembly is lockable to at least one mounting insert and the at least one mounting rail, such that each blade assembly is positioned orthogonal to the wall.

* * * * *